United States Patent [19]

Meyers, Leo J.

[11] 4,087,084

[45] May 2, 1978

[54] APPARATUS FOR CHANGING BLAST FURNACE TUYERES

[75] Inventor: Meyers, Leo J., Penn Hills, Pa.

[73] Assignee: Louis A. Grant, Inc., Pittsburgh, Pa.

[21] Appl. No.: 827,179

[22] Filed: Aug. 24, 1977

Related U.S. Application Data

[63] Continuation of Ser. No. 626,048, Oct. 28, 1975, abandoned.

[51] Int. Cl.[2] ..... F27B 1/10

[52] U.S. Cl. ..... 266/287; 173/23; 173/43; 214/1 BB

[58] Field of Search ..... 164/137, 302, 332, 339, 164/340, 345; 214/1 BB; 266/47, 135, 265, 269, 271, 281, 287; 173/23, 43; 254/84; 299/70

[56] References Cited

U.S. PATENT DOCUMENTS

| | | | |
|---|---|---|---|
| 3,314,671 | 4/1967 | Heino et al. | 266/271 |
| 3,834,761 | 9/1974 | Ray et al. | 173/23 |
| 4,037,828 | 7/1977 | Terada et al. | 266/271 |

*Primary Examiner*—Gerald A. Dost
*Attorney, Agent, or Firm*—Buell, Blenko & Ziesenheim

[57] ABSTRACT

An apparatus for removing and replacing blast furnace tuyeres. The apparatus is indexed with the centerline of the tuyere and downcomer from the bustle pipe to permit removal and replacement of the blowpipe-elbow, tuyere and tuyere cooler.

6 Claims, 12 Drawing Figures

APPARATUS FOR CHANGING BLAST FURNACE TUYERES

This is a continuation of application Ser. No. 626,048, filed Oct. 28, 1975, and now abandoned.

This invention relates to an apparatus for changing blast furnace tuyeres and particularly to an apparatus which can be indexed and stabilized along the centerline of the bustle pipe downcomer and tuyere, thereby permitting not only the removal and reinstallation of a tuyere but also of the blowpipe-elbow and tuyere cooler. Various attempts have been made to mechanize the removal and replacement of blast furnace tuyeres, however, it remains common practice in the steel industry today to remove and replace the tuyeres by manual labor employing the simplest of hand tools. The removal and reinstallation of the tuyeres is expensive both in terms of man hours employed and blast furnace down time. Furthermore, the manual operation is extremely difficult and laborious because of the heat and crowded conditions in which the removal and reinstallation are performed.

Previous attempts to mechanize tuyere replacement have met with very limited, if any, success. Operability of prior apparatus was severly impaired by space limitations caused by the auxiliary equipment within the proximity of the tuyere. These crowded conditions often prevented the apparatus from being brought into proper alignment with the tuyere so that it could be extracted from the furnace. Also, since the apparatus could not be properly indexed, it could not be used to reinstall the elbow and blowpipe and thereby a large amount of manual labor was required for these operations. Further, the mill floor was often uneven in the area of the blast furnace, and the prior art devices could not be stabilized to perform the removal and reinstallation operations. The present invention provides a novel and significant improvement over the present apparatus and methods of tuyere removal and reinstallation. The invention provides an apparatus which permits tuyere removal and reinstallation in a facile, economical and efficient manner, and greatly eases the severe conditions under which laborers must work.

In a preferred form of my invention, I provide a main undercarriage mounted on cats to provide mobility to and from the particular tuyere to be replaced. Mounted to the main undercarriage is a plurality of hydraulic screw jacks, which can be raised or lowered to stabilize and level the undercarriage if the mill floor surrounding the blast furnace is uneven. Movably mounted on the main undercarriage is a first subcarriage. The first subcarriage is movable longitudinally relative to the main undercarriage by means of hydraulic cylinders attached to the undercarriage and first subcarriage. Movably mounted on the first subcarriage is a second subcarriage which is capable of movement laterally of the first subcarriage by means of hydraulic cylinders attached to the first and second subcarriage. A turntable means is rotatably attached to said second subcarriage and is capable of rotation with respect thereto.

Blowpipe-elbow, tuyere and tuyere cooler removal means and cutting means for cleaning the accumulated slag at the tuyere cavity are removably operably attached to the turntable. The blowpipe-elbow removal means is preferably a cradle type apparatus adapted to engage and support the blowpipe-elbow during removal from the furnace and reinstallation thereon. The tuyere and tuyere cooler removal means and the cutting means are adapted to be insertable on a carrier which is operably attached to the turntable. The carrier means is comprised of a base, boom means supported therefrom, pneumatic hammer means operably attached thereto and hydraulic cylinder means operably attached thereto and adapted to operably engage the tuyere and tuyere cooler removal tools.

In operation, the apparatus of the present invention would be moved into the area of the furnace adajcent the tuyere selected for replacement. The apparatus is then indexed with the blowpipe-elbow by means of the hydraulic jacks mounted on the main undercarriage and the longitudinal movement of the first subcarriage, lateral movement of the second subcarriage and rotational movement of the turntable. When the apparatus is properly indexed, it is raised by means of the hydraulic jacks to engage the blowpipe-elbow. The blowpipe-elbow is then disconnected from the bustle pipe, the hydraulic jacks are lowered to permit movement of the undercarriage. The entire apparatus is then withdrawn from the furnace area with the blowpipe-elbow secured to the cradle means mounted on the turntable. A forklift or other lifting device would then remove the cradle means with the blowpipe-elbow resting thereon from the turntable. The carrier means with the tuyere removal tool and cutting means for cleaning the tuyere cavity would then be placed on the turntable. By use of the cats mounted on the undercarriage, the apparatus would then be returned to the furnace area and aligned with the exposed tuyere. The tuyere removal tool would be inserted into the tuyere. The pneumatic hammer means would vibrate the tuyere to loosen it. While the tuyere is being vibrated, the hydraulic cylinder operably attached to the tuyere removal tool carrier 45 actuated to extert a constant pull on the tuyere to cause it to withdraw from the tuyere cooler. The first subcarriage is moved from the furnace and the turntable rotated to permit removal of the tuyere from the removal tool.

If there was a sufficient amount of slag accumulated in the tuyere cavity to necessitate cleaning of the cavity, the cutter means which are located on the boom at the extreme end from the tuyere removal tool could be positioned in line with the tuyere cavity. The cutting means would be inserted into the cavity. The hydraulic cylinders operably attached to the boom having been rotated 180° would exert a force in the direction of the furnace as causing a pushing action to enable the cutting means to remove the slag from the cavity.

After the slag had been removed, if a visual inspection of the tuyere cooler revealed it to be in unsatisfactory condition, the cutting means could be removed from the boom and the tuyere cooler removal tool inserted thereon. The tuyere cooler removal tool would be inserted into the tuyere cooler and by movement of the first undercarriage the tuyere cooler would be removed from the furnace. The tuyere cooler could be further inspected and be replaced by reversing the operation.

A new tuyere would then be placed on a tuyere removal tool and by actuation of the hydraulic cylinders inserted in the tuyere cooler.

After the new tuyere had been inserted into the tuyere cooler, the apparatus would be withdrawn from the furnace area and the carrier means removed and the cradle means with blowpipe and elbow resting thereon reinserted on the turntable. The apparatus would be once again properly indexed with the centerline of the downcomer of the bustle pipe and the tuyere. The blowpipe-elbow could then be reattached to the tuyere and downcomer.

In the foregoing general description I have set out certain purposes, objects and advantages of my invention. It will be described hereafter and will become apparent to those skilled in the art of blast furnace maintenance when considering the following descriptions and drawings in which.

Figure 1:
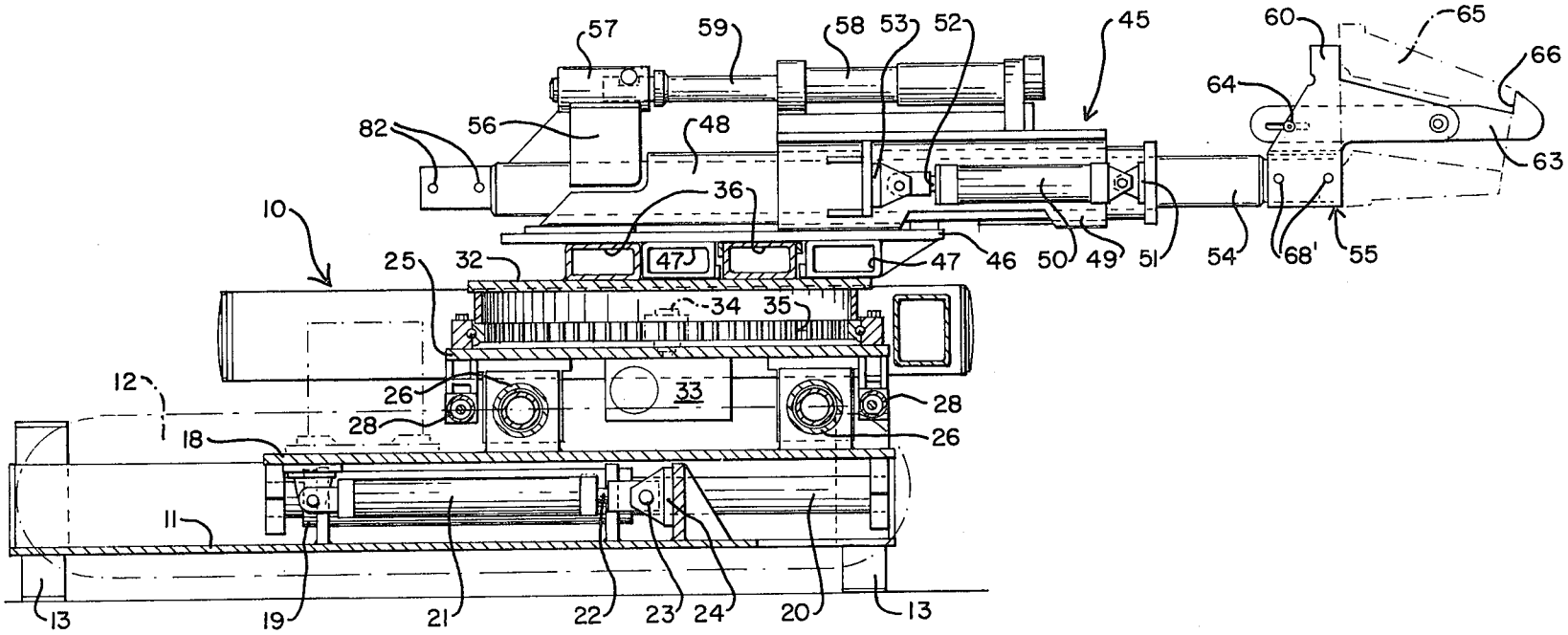
FIG. 1 is a side elevational view of the apparatus of this invention partially in section.
Figure 2:
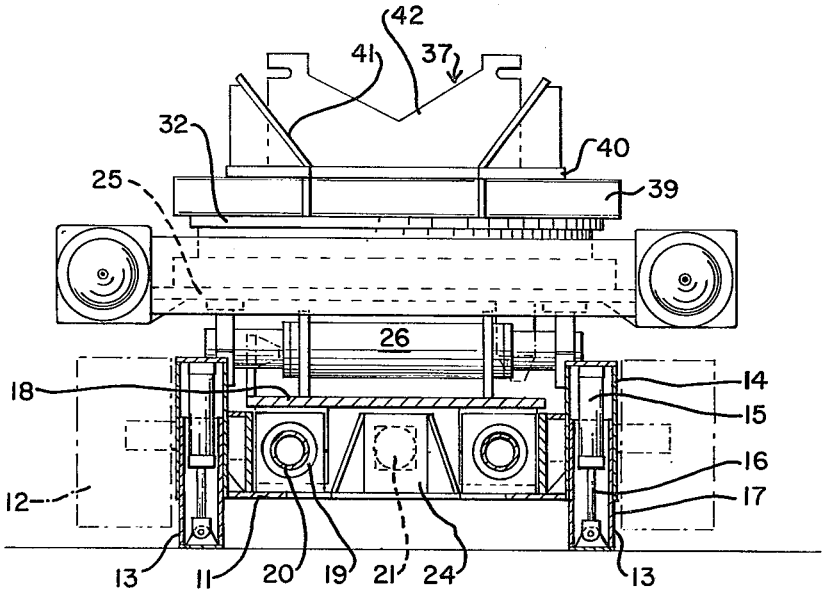
FIG. 2 is a front elevational view of the apparatus of this invention partly in section showing the blowpipe-elbow removal means mounted thereon.

Referring to the drawings I have illustrated in FIG. 1 the apparatus of this invention which is generally designated 10. The undercarriage 11 of the apparatus has crowlers 12 shown in chain line which enables the entire apparatus to move to and from various work locations. Four hydraulic jacks 13 are operably mounted to undercarriage 11 at its corners. Jacks 13 are hydraulic and are comprised of outer fixed tube 14 which is mounted on undercarriage 11. Cylinder 15 is fixed to tube 14. Piston 16 of cylinder 15 is attached to inner tube 17 which telescopes with respect to tube 14. Jacks 13 may be operated independently or in combination to raise, lower or tilt undercarriage 11 to any desired position.

Attached to undercarriage 11 is first subcarriage 18. First subcarriage 18 is attached to the undercarriage by means of telescopic guide tubing. Outer guide tube 19 is fixed to undercarriage 11. Inner sliding tube 20 is fixed to first subcarriage 18. Tubes 19 and 20 are slideably engaged so that tube 20 may move longitudinally with respect to tube 19. Mounted to subcarriage 18 is a hydraulic cylinder 21. Hydraulic cylinder 21 has piston rod 22 which is operably connected by means of pin 23 and bracket 24 to undercarriage 11. Activation of cylinder 21 causes subcarriage 18 to move longitudinally with respect to undercarriage 11. Second subcarriage means 25 are mounted by telescopic guide tube arrangement to the first subcarriage. Outer guide tubes 26 are fixed to first subcarriage 18. Inner sliding tubes are fixed to second subcarriage 25. Cylinder 28 is fixed to first subcarriage 18. Piston 29 is affixed to second subcarriage 25 by means of pin 30 and bracket 31. Activation of cylinder 28 will cause subcarriage 25 to move laterally with respect to subcarriage 18.

Mounted on subcarriage 25 is turntable 32. Turntable 32 is rotated with respect to subcarriage 25 by means of hydraulic motor 33, pinion 34 and internal ring gear 35 within turntable 32. Indexing tubes 36 are fixed to turntable 32.

Figure 3:
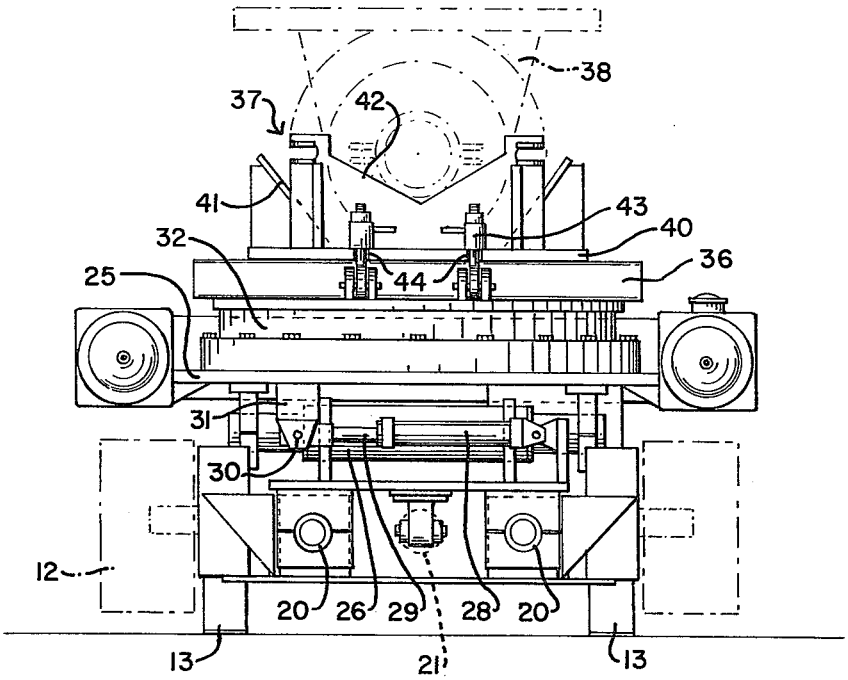
FIG. 3 is a rear elevational view showing the blowpipe-elbow in chain line mounted on the carrier means.
Figure 4:
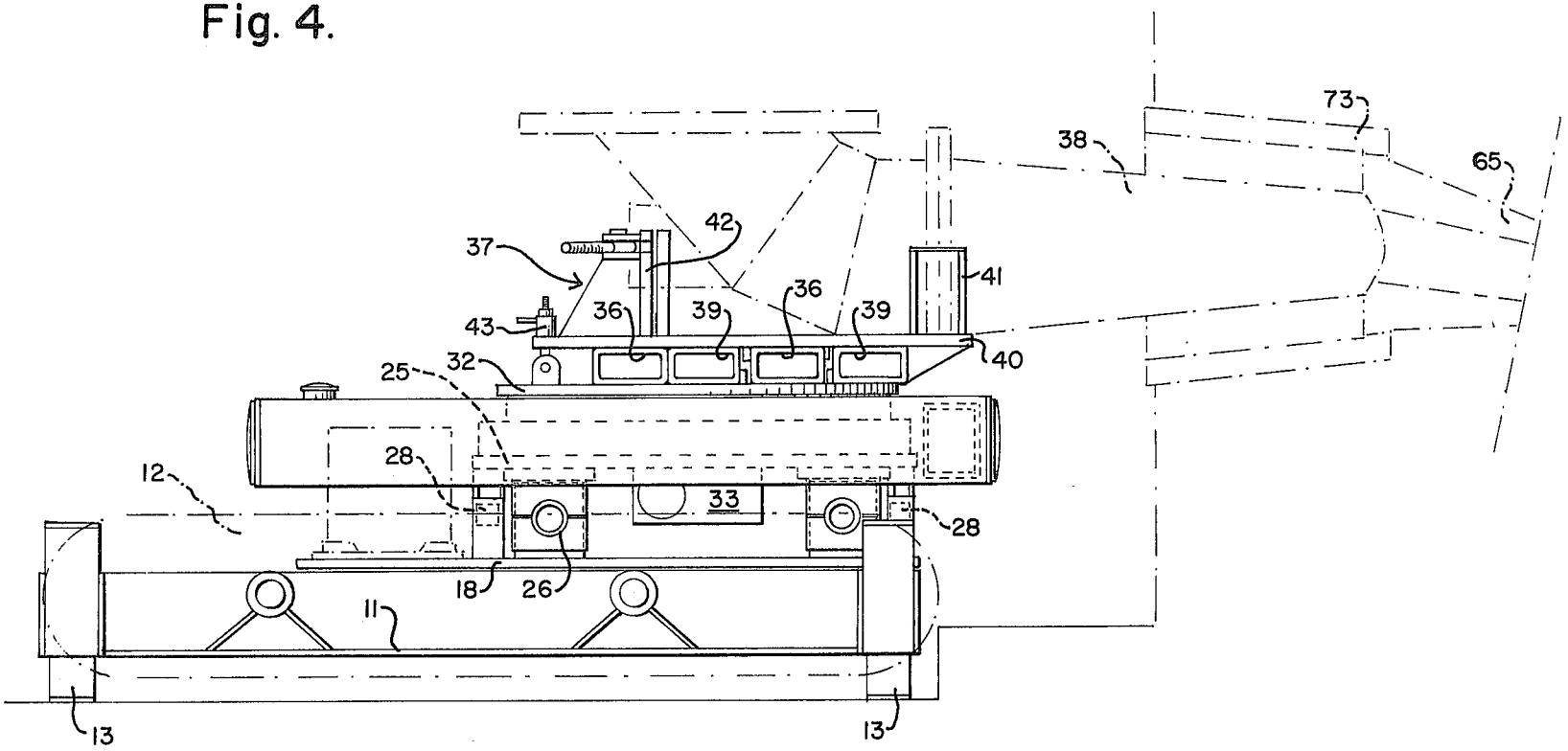
FIG. 4 is a side elevational view of the apparatus of this invention showing the apparatus indexed with the blowpipe-elbow of a blast furnace.

FIGS. 3 and 4 illustrates the cradle 37 which is designed to receive a blowpipe-elbow 38, shown in chain line, of the blast furnace. Cradle 37 is comprised of structural tubes 39 joined to base 40 and indexed with tubes 36. By so positioning base 40 it is removably operably mounted on turntable 32. Support means comprises a saddle 41 and a retaining means 42. Lock means 43 engage slots 44 in base 40 to prevent possible tipping of the cradle 37 when conveying the blowpipe-elbow away from the furnace.

Tool carrier 45 is comprised of a base 46 having like structural tubes 47 which correspond to tubes 39 on base 40. Mounted on base 46 is second tubular section 48 having slideably telescoped thereon a first tubular section 49. Hydraulic cylinders 50 are fixed at the right end to tube 48 at bracket 51, viewing FIG. 1, and each has its piston rod 52 connected to a bracket 53 which is fixed to tubular section 49. Slideably telescoped within second tubular section 48 is a third tubular member 54 which has removably mounted on its right hand end, viewing FIG. 1, tuyere removal tool 55. At the left end of member 54 is support 56 which carries an impact anvil 57. Pneumatic hammer 58 is mounted on first tubular member 49 and each has its transmitting rod 59 slideably attached to impact anvil 57. By slideably attaching rod 59 to anvil 57, the travel of member 54 is limited.

Figure 9:
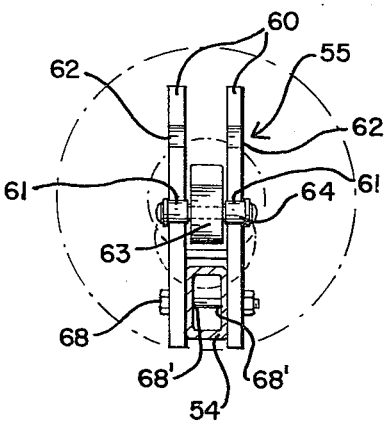
FIG. 9 is a view taken on line IX—IX of FIG. 8.
Figure 8:
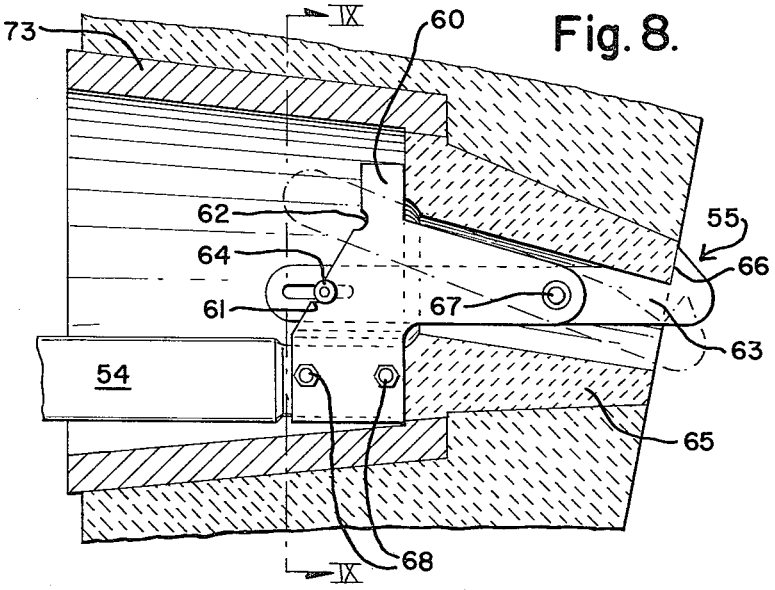
FIG. 8 is a side elevational view of the tuyere removal and installation tool shown engaging the tuyere prior to removal from the tuyere cavity and cooler.

Tuyere removal tool 55, FIGS. 8 and 9 is comprised of plates 60 mounted on tubular member 54. Detents 61 and 62 in plates 60 are used to latch arm 63 by means of pin 64 in position to either insert into or remove tuyere 65 from the tuyere cavity of the furnace. Arm 63 has catch means 66 pivotably attached by means of pin 67. Tuyere removal tool is removably mounted on tubular member 54 by pins 68 which engage apertures 68′ in member 54.

Figure 5:
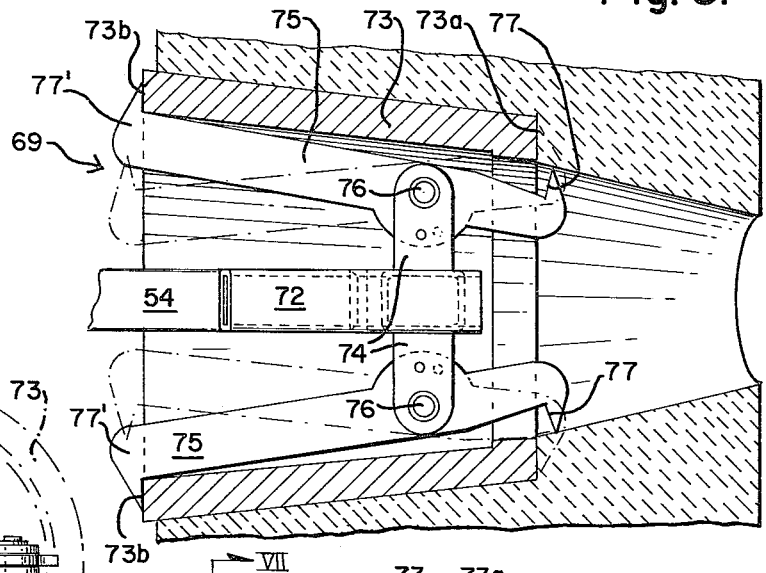
FIG. 5 is a top plan view of the tool used to remove and install the tuyere cooler illustrated in the installations position.
Figure 7:
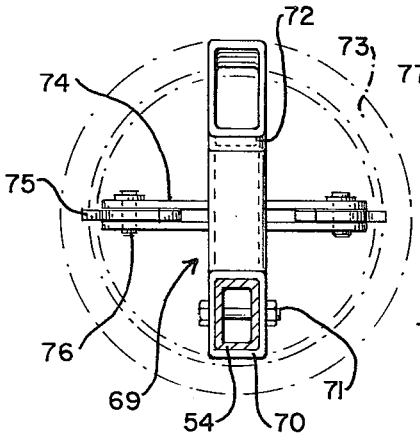
FIG. 7 is a view taken along line VII—VII of FIG. 6.
Figure 6:
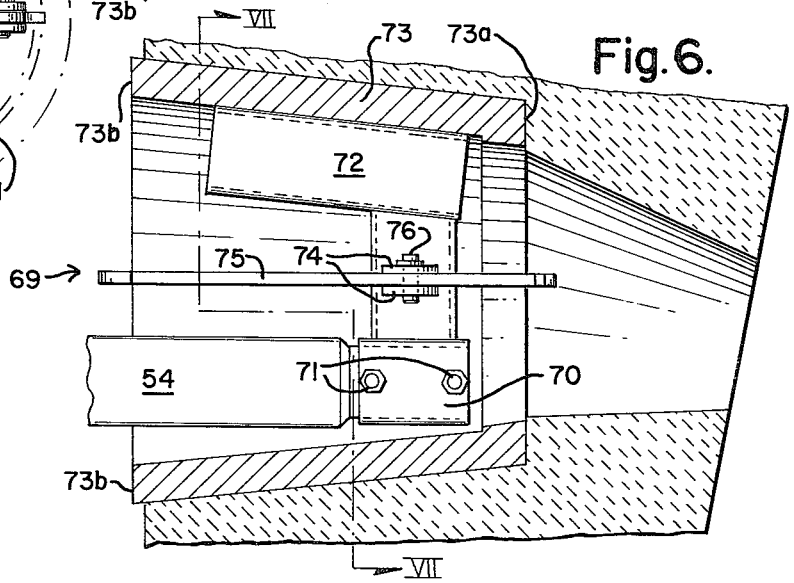
FIG. 6 is a side elevational view of FIG. 5.

The tuyere cooler removal tool 69, FIGS. 5, 6 and 7, is comprised of a base support 70 which is adapted to slideably fit on tubular member 54 and be attached to it by means of bolts 71 which engage apertures 68′ in member 54. Fixed to base member 70 is support member 72. Support member 72 is adapted to engage and support the tuyere cooler 73. Extending from member 72 are flanges 74 which engage and pivotably support arms 75 by means of pins 76. Each of arms 75 have catch means 77 at either end to engage the tuyere cooler.

Figure 10:
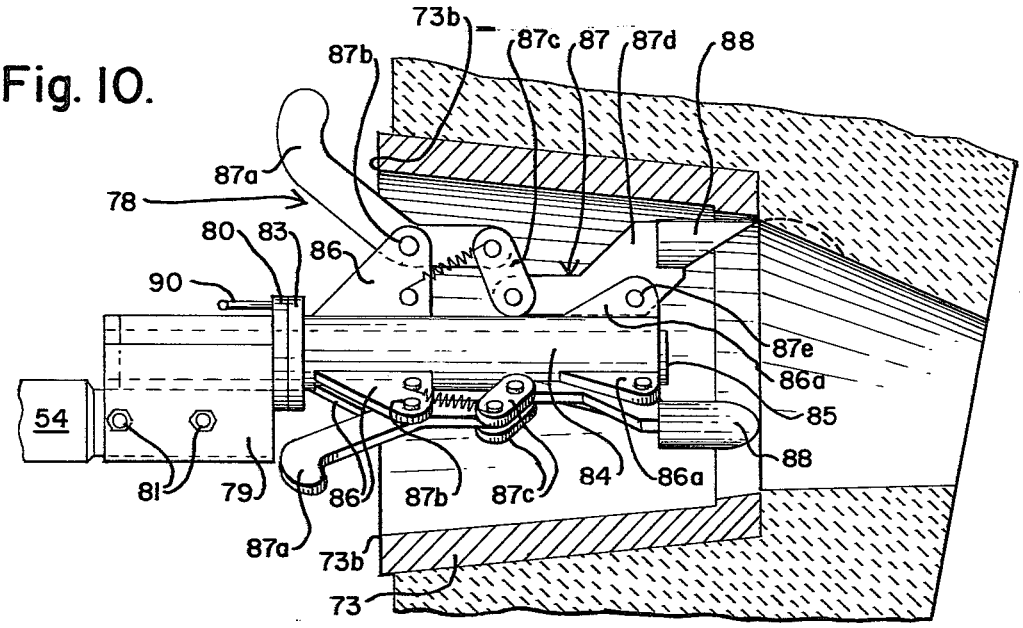
FIG. 10 is a side elevational view of the tuyere cooler and tuyere cavity in section showing insertion of the slag cutting means.
Figure 11:
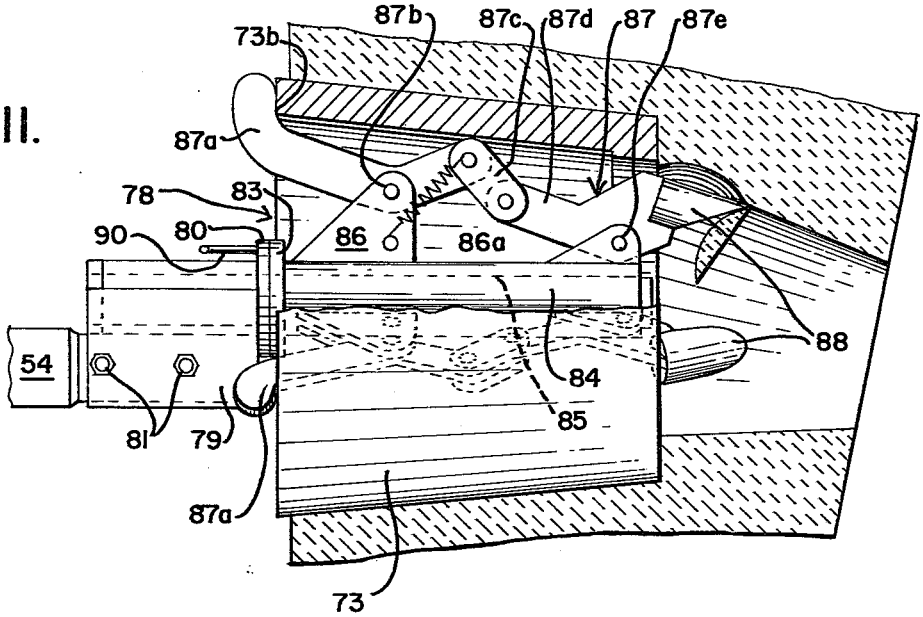
FIG. 11 is a side elevational view of the tuyere cooler and tuyere cavity in section showing the slag cutting means in operation.
Figure 12:
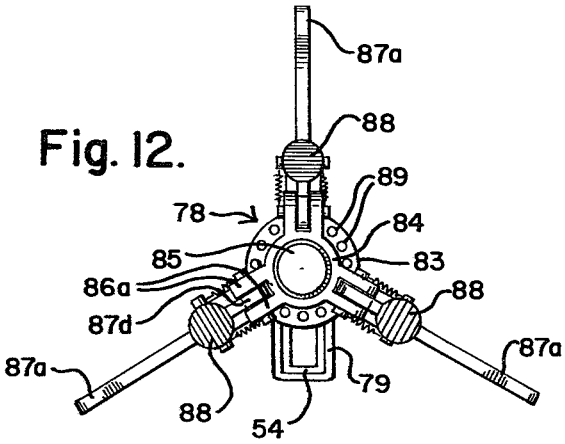
FIG. 12 is a front elevational view of the slag cutting means of this inention.

The slag cutting tool 78, FIGS. 10, 11 and 12, is comprised of a mounting member 79 having annular plate 80 fixed thereto. Mounting 79 is adapted to engage the left hand end, viewing FIG. 1, of tubular member 54 by means of bolts 81 which engage apertures 82 in member 54. Annular plate 83 is fixed to cylindrical housing 84. Shaft 85 is fixed to mounting member 79 and extends through annular plates 80 and 83 and cylindrical housing 84. Brackets 86 are mounted on housing 84 and pivotably engage cutting linkage 87 to which is fixed cutters 88. Housing member 84 and its annular plate 83 are rotatable over shaft 85. Annular plates 80 and 83 have indexing apertures 89 by which plate 83 and member 84 can be aligned in various positions with plate 80. and locked in this position by a pin 90.

In operation the apparatus 10 with cradle 37 mounted on turntable 32 is brought into proximity with the blast furnace blowpipe-elbow of the tuyere to be replaced. By adjustment of hydraulic jacks 13, the longitudinal movement of first subcarriage 18, the lateral movement of second subcarriage 25 and rotation of turntable 32, the cradle would be indexed to receive the blowpipe-elbow which would be unfastened from the furnace and left to rest on the cradle 37. Jacks 13 would be adjusted to allow the apparatus to withdraw with the blowpipe-elbow, a forklift would remove the cradle from the turntable by engaging structural tubes 39.

Tool carrier 45 would then be mounted on the turntable and the apparatus returned by means of crawlers 12 to the furnace. Tuyere removal tool 55 would be mounted on tubular member 54. Actuation of cylinders 50 would cause members 49 and 54 to move to the right, viewing FIG. 1, and advance the tool 55 within the tuyere (FIG. 8). The catch means 66 of tool 55 would be latched in the position shown in solid line to allow catch 66 to engage tuyere 65. Cylinders 50 are then reactivated to pull the tuyere from its cavity. To assist in removing the tuyere, pneumatic hammer 58 would be activated to impact anvil 57. Impacting anvil 57 would vibrate tubular member 54 away from the furnace causing further loosening of the tuyere to facilitate removal. Hydraulic cylinder 21 would be activated to move the first subcarriage 18 away from the furnace. It is seen that the movement of subcarriage 18 would cause member 49, member 54 and tool 55 to pull away from the furnace to permit the tuyere to be removed from the tool. After removal of the tuyere, tool 55 could be positioned by movement of the apparatus to permit the old tuyere to be removed and a new one inserted thereon.

If it were desirable to clean accumulated slag from the tuyere cavity, cutter tool 78 would be mounted on the left end of member 54. Turntable 32 would be rotated 180° and by the longitudinal movement of the first subcarriage 18 and member 54, the cutting tool would be inserted into the tuyere cavity. Bell crank **87*a* is pivoted at 87*b* to bracket 86. Connecting link 87*c* is pivoted at each end connecting 87*a* to bell crank 87*d* which is pivoted at 87*e* to bracket 86*a*. Cutters 88 are mounted on bell cranks 87*d* of linkage 87. Arm 87*a* contacts the trailing edge 73*b* of the cooler 73 and pressure exerted causes the linkage to rotate about its pivots and assume the position in FIG. 11 to remove the slag. Pneumatic hammer 58 would again be activated but since member 54 has been rotated 180° it would vibrate member 54 toward the furnace allowing cutters 88 to contact and remove the slag from the tuyere cavity. Once the slag in that position is removed from the tuyere cavity if visual inspection made it necessary to remove other deposits, pin 90 could be removed from the indexing apertures 89 and housing 84 rotated over shaft 85 to position cutters 88 to remove the new slag deposit. Once the cutters had been properly positioned, pin 90** is reinserted to lock the cutting tool and the operation is repeated. The steps are repeated as often as necessary to remove all the built up slag from the tuyere cavity.

A visual inspection is then made of the tuyere cooler. If the tuyere cooler is found defective, the tuyere cooler tool 69 would be mounted on boom 54 in place of tool 55. Tool 69 would be inserted into the tuyere cooler so that support member 72 would engage the tuyere cooler 73. (FIGS. 5, 6 and 7). Catch members 77 would engage the trailing edge **73*a* of the tuyere cooler and movement of the first subcarriage and member 54 as previously described would cause removal of the tuyere cooler. A new tuyere cooler could then be placed on the tool and reinserted by reversing the movement of the first subcarriage 18 and boom 54. In reinserting the cooler arms 75 would be positioned as shown solid line in FIG. 5 and catch member 77' of arm 75 would engage the trailing edge 73*b* of the cooler 73**.

Once the slag had been removed and the tuyere cooler inspected, a new tuyere would then be inserted. The tuyere would be mounted on tool 55 as shown in FIG. 1 with arm 63 and catch means 66 latched in the position shown in FIG. 1. Subcarriage 18 and boom 54 would be moved as necessary toward the furnace to reinsert the tuyere inside the tuyere cooler and cavity. Catch means 66 would then be latched in the chain line motion shown in FIG. 8 and the tool 55 withdrawn from the tuyere.

The apparatus would then be removed from the furnace area, the tool carrier 45 removed and the cradle 37 carrying the blowpipe-elbow replaced on the turntable by means of a forklift. The apparatus would then be returned to the furnace area and properly indexed with the centerline of the downcomer of the bustle pipe to permit reinstallation of the blowpipe-elbow. The apparatus of the present invention by permitting four dimensional movement permits this proper indexing for all operations including blowpipe-elbow reinstallation which was not possible in the prior art.

In the foregoing specification I have set out certain preferred embodiments of my invention, however, it will be understood that this invention may be otherwise embodied within the scope of the following claims.

I claim:

1. Apparatus for removing and replacing blast furnace tuyeres and attendant structure comprising:

(a) mobile undercarriage means having uneven ground engaging jack means attached thereto to raise and lower said undercarriage to different fixed levels, (b) first subcarriage means mounted on said undercarriage movable longitudinally with respect thereto, (c) second subcarriage means mounted on said first subcarriage and movable laterally with respect to said first subcarriage and said undercarriage, (d) rotatable platform means mounted on said second subcarriage means and rotatable in relation to said subcarriages and undercarriage means, and (e) an elongated member movable longitudinally on said rotatable platform means and adapted to carry tool means at each end, and hammer means for impacting said elongated member so as to vibrate it longitudinally.

2. Apparatus of claim 1 in which the means for impacting said elongated member are adjusted to impact it in one longitudinal direction only.

3. Apparatus of claim 1 in which said tool means comprise catch means for withdrawing a tuyere from a tuyere cavity, said tuyere withdrawing means being mounted on an end of said elongated member so as to be vibrated by said hammer means away from said tuyere cavity.

4. Apparatus of claim 3 in which the tuyere withdrawing means comprise an arm pivotally mounted adjacent the end of said elongated member so as to extend forward of that pivot and terminating in a catch which overlies the inside end of a tuyere when said arm is inserted into said tuyere.

5. Apparatus of claim 1 in which said tool means comprise cutter means for removing slag from a tuyere cavity, said cutter means being mounted on an end of said elongated member so as to be vibrated by said hammer means toward said tuyere cavity.

6. Apparatus of claim 5 in which said slag cutter means comprise cutter tools mounted on the outer ends of toggles pivoted forwardly of the end of said elongated member and means for rotating those toggles so as to force said cutter tools into slag accumulations in a tuyere cavity when said cutter means are advanced into a tuyere cooler.

* * * * *